US008413299B2

(12) United States Patent
Bartels

(10) Patent No.: US 8,413,299 B2
(45) Date of Patent: Apr. 9, 2013

(54) HINGE FOR DOOR OR WINDOW

(75) Inventor: Thomas Bartels, Oelde (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 160 days.

(21) Appl. No.: 13/070,145

(22) Filed: Mar. 23, 2011

(65) Prior Publication Data

US 2011/0232033 A1 Sep. 29, 2011

(30) Foreign Application Priority Data

Mar. 23, 2010 (DE) ..... 10 2010 012 574

(51) Int. Cl.
*E05D 7/04* (2006.01)

(52) U.S. Cl. ..... 16/236; 16/238; 16/245

(58) Field of Classification Search ..... 16/235–238, 16/242–248, DIG. 34, DIG. 39; 49/390
See application file for complete search history.

(56) References Cited

U.S. PATENT DOCUMENTS 4,142,272 A * 3/1979 Oogami et al. ..... 16/245
4,209,946 A * 7/1980 Akai ..... 49/390
5,063,638 A * 11/1991 Howard et al. ..... 16/238
5,713,105 A * 2/1998 Toomey ..... 16/245
7,331,085 B2 * 2/2008 Heid ..... 16/242
7,334,293 B2 * 2/2008 Erickson et al. ..... 16/243
7,346,959 B2 * 3/2008 Heid ..... 16/242
7,676,887 B2 * 3/2010 Chung ..... 16/236
7,861,378 B2 * 1/2011 Neukotter ..... 16/366
8,196,265 B2 * 6/2012 Neukoetter et al. ..... 16/389

FOREIGN PATENT DOCUMENTS

DE 29817807 U 7/1999

* cited by examiner

*Primary Examiner* — William L. Miller
(74) *Attorney, Agent, or Firm* — Andrew Wilford

(57) ABSTRACT

A hinge for mounting a door-panel or window sash to a fixed jamb element has two leaves pivoted together about an axis. One of the leaves is adapted for attachment directly to an edge of one of the elements. A housing is recessed in the other of the elements and has a pair of generally parallel and vertical side walls with inner faces defining a horizontally open cavity. A bar is shiftable in the cavity horizontally perpendicular to the side walls and vertically. At least one fastener releasably securing the other of the leaves to the bar. A pair of spindles extending perpendicular to the side walls in the cavity are threaded into the bar and have opposite ends bearing on the inner faces of the side walls so that rotation of the spindles shifts the bar perpendicular to the side walls.

12 Claims, 3 Drawing Sheets

HINGE FOR DOOR OR WINDOW

FIELD OF THE INVENTION

The present invention relates to a door or window hinge. More particularly this invention concerns such a hinge used in a door or window of largely plastic construction.

BACKGROUND OF THE INVENTION

The window sashes or door panels of plastic window and door assemblies normally have a frame surrounding the sash or door panel and a jamb in which the frame fits that are made of hollow plastic profiles. For the sake of appearance, the connecting parts of the hinge to be fastened to the door panel or window sash and to the jamb should be visible as little as possible adjacent the hinge knuckle where the hinge leaves pivot on each other. At the same time, an adjusting mechanism must be provided that allows precise, convenient side-to-side adjustment of the door panel or sash parallel to the plane of the panel or jamb relative to the jamb, and must be integrated into the hinge in a space-saving manner. An additional vertical adjustment of the door or window sash as well as a front-to-back contact pressure adjustment perpendicular to the plane of the door panel or window sash, that is horizontally in the closing direction, should preferably be possible.

A hinge for plastic doors and plastic windows is known from DE 298 17 807, having two pivoted-together hinge leaves, one of the hinge leaves having a housing for fastening to a door or window jamb, and a holder for the hinge leaf on the frame side which may be installed through an opening on the back side of this housing. The holder has a mechanism for vertically adjusting the hinge leaf on the jamb. The lateral adjustment of the door panel or window sash must be performed on a separate holding block that may be fastened to a frame structure of the jamb and that has an adjusting mechanism cooperating with the hinge leaf on the leaf side. The holding block, which is screwed onto the door leaf, is clearly visible on the exterior of the door leaf and detracts from the appearance of the door or window.

OBJECTS OF THE INVENTION

It is therefore an object of the present invention to provide an improved hinge for a plastic door or window assembly.

Another object is the provision of such an improved hinge for door or window that overcomes the above-given disadvantages, in particular that allows at least a lateral adjustment of the door leaf, and that may be screwed onto the hollow profiles of the frame and the leaf, and whose screw-on parts are characterized by compact external dimensions.

SUMMARY OF THE INVENTION

A hinge for mounting a door-panel or window sash to a fixed jamb element has according to the invention two leaves pivoted together about an axis. One of the leaves is adapted for attachment directly to an edge of one of the elements. A housing is recessed in the other of the elements and has a pair of generally parallel and vertical side walls with inner faces defining a horizontally open cavity. A bar is shiftable in the cavity horizontally perpendicular to the side walls and vertically. At least one fastener releasably securing the other of the leaves to the bar. A pair of spindles extending perpendicular to the side walls in the cavity are threaded into the bar and have opposite ends bearing on the inner faces of the side walls so that rotation of the spindles shifts the bar is perpendicular to the side walls.

The length of the threaded spindles is adapted to the interior dimensions of the housing in such a way that they may be displaced vertically as well as horizontally, in the installation direction, along the inner faces of the housing. In the installed state, the retaining bar rests against a front face of the housing, at least above and below a hinge receiving slot, and at the back side of the housing is essentially flush with the support surface of the housing. When the housing is screwed onto a window frame or door frame, the retaining bar is supported on the one hand against the hollow profile of the frame, and on the other hand by the front wall of the housing, and is thus protected from tilting motions in its plane. It is understood that the open back side of the housing may be closed off by a cover panel. However, such a cover is not necessary from a functional standpoint.

at least one end face of each threaded spindle has a tool recess that is accessible through an opening in the housing for the positive-fit engagement of a rotary tool. The opening is dimensioned in such a way that the end face of the threaded spindle is sufficiently supported at the periphery of this opening, that is it is significantly smaller than the end face of the spindle but larger than the recess, typically a hex socket.

At its upper and lower ends the housing preferably has end pieces holding vertically displaceable bearing elements for supporting the retaining bar. By displacing the bearing elements, a door leaf or window leaf attached to the hinge may be vertically displaced and precisely adjusted with respect to the frame. One particularly simple and advantageous embodiment provides that the bearing elements are screwed into vertical threaded holes, and are accessible through openings at the lower and upper ends of the housing. However, an adjusting eccentric or an apparatus having a bolt and an adjusting screw that acts on a wedge face of the bolt may also be used.

According to one preferred design of the invention, the retaining bar and the hinge tab are directly detachable connected to one another. Screw fasteners between the hinge leaf and the retaining bar represent a particularly space-saving connection. The screws are advantageously engaged in threaded holes in the hinge leaf, and pass through openings in the retaining bar that allow relative motions between the retaining bar and the hinge leaf in the insertion direction of the hinge before the screws are tightened. The spacing of the door leaf or window leaf from the frame in the closing direction may be adjusted and the contact pressure at a door seal may be set by horizontally displacing the hinge leaf relative to the retaining bar. The screws that join the retaining bar to the hinge leaf preferably have countersunk heads and are flush with the retaining bar.

The hinge according to the invention may also be provided with an additional device for adjusting contact pressure, with little technical complexity. The contact pressure adjustment may be achieved very easily using an adjusting eccentric that is rotatably mounted on the retaining bar and situated within an aperture in the hinge leaf, and that cooperates with the shape of the aperture.

The housing of the hinge according to the invention is preferably designed as a one-piece cast metal part, and may have openings for fastening screws as well as centering lugs that project at the back side of the housing.

BRIEF DESCRIPTION OF THE DRAWING

The above and other objects, features, and advantages will become more readily apparent from the following description, reference being made to the accompanying drawing in which.

DETAILED DESCRIPTION

Figure 1:
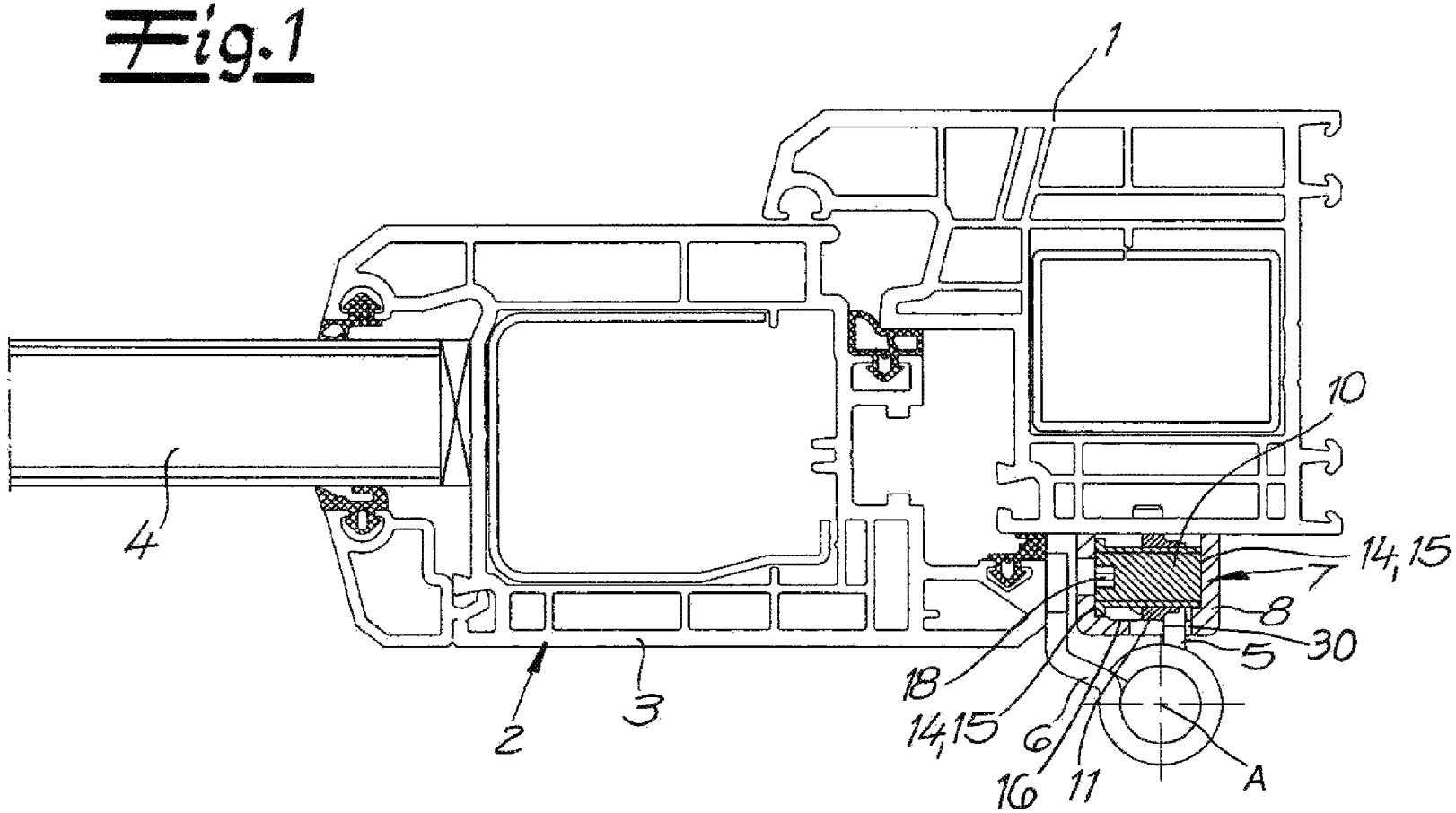
FIG. 1 is a horizontal cross section through a door hinge on a plastic door according to the invention.

As seen in FIG. 1 a hinge connects a door frame 1 made of a hollow plastic profile to a door 2. The door 2 has a frame 3 made of a hollow plastic profile, and a panel 4 that may be made of laminated board or an insulated glass sheet, for example. The hinge further has two hinge leaves 5 and 6 pivoted together at a vertical axis A by a pintle 27 (FIG. 2), and a mount 7 that has a housing 8 for fastening to the door frame 1, as well as a holder 9 for one of the hinge leaves, here the hinge leaf 5.

Figure 2:
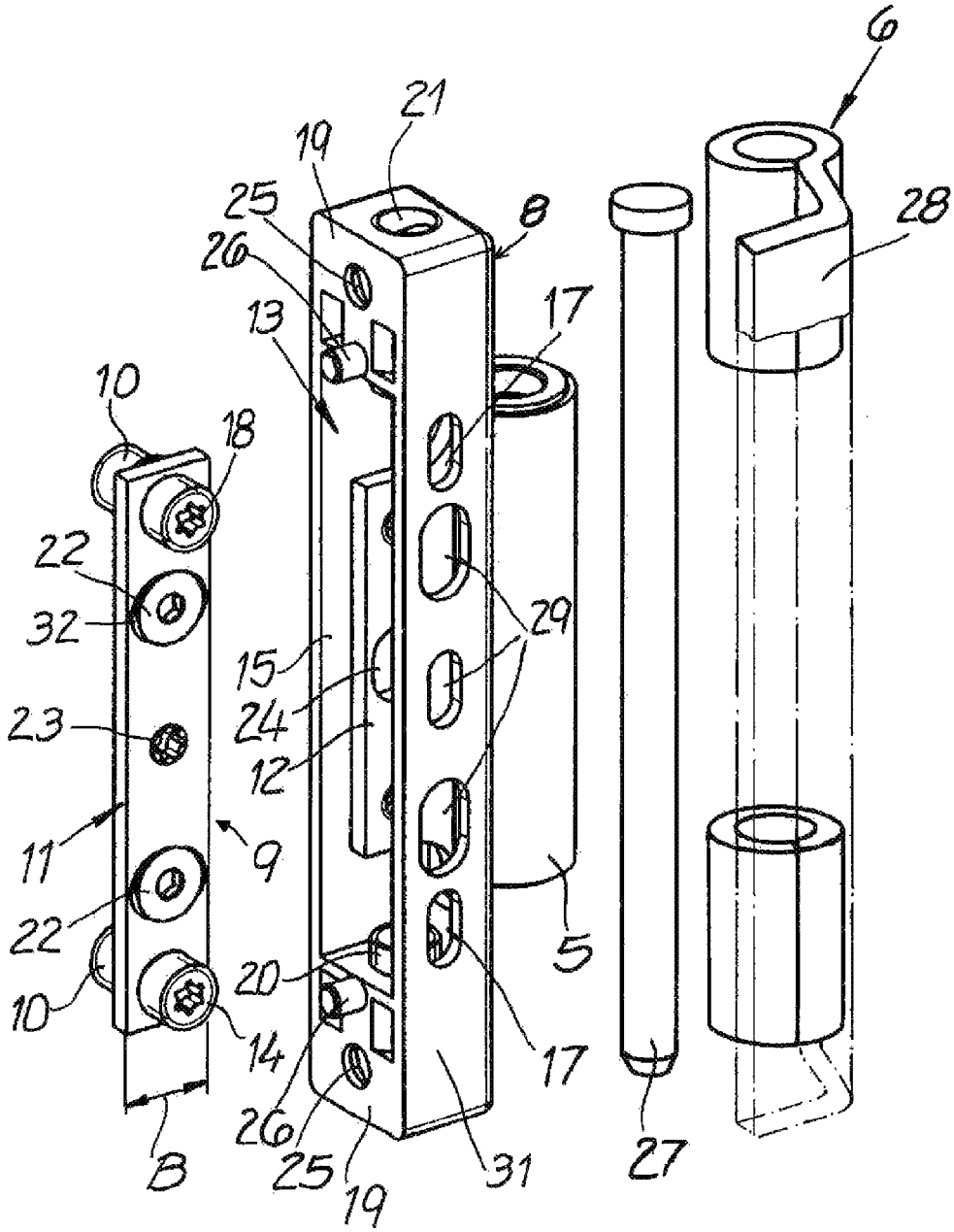
FIG. 2 is an exploded view of the door hinge.

As shown in the exploded view of FIG. 2, the holder 9 has a flat metal retaining bar 11 that is mounted on two threaded spindles 10, and that is also detachably connected to a tab 12 of the hinge leaf 5. The holder 9 may be installed through an opening or open back side 13 of the housing 8.

The threaded spindles 10 have a length that is equal to or slightly shorter than the interior dimension of the housing 8 between its parallel and vertical side walls 31, and at their end faces 14 rest against inner faces 15 of the walls 31 of the housing 8 in a rotationally displaceable as well as a vertically and horizontally slidable manner. The width B of the retaining bar 11 corresponds to the horizontal depth of the housing interior parallel to the side-wall faces 15, so that the retaining bar 11 on the one hand rests against the back face of a front wall 16 of the housing 8, at least above and below a slot 30 (FIG. 1) formed in the front wall 16 of the housing 8 and through which the hinge tab 12 fits with vertical and horizontal play. On its back edge, the rectangular bar 11 is essentially flush with the back edges of the side walls 31 of the housing 8. When installed as shown in FIGS. 1 and 3, the bar 11 is thus supported on the hollow profile of the door frame 1 and on the front face 16 of the housing 8, so that the hinge leaf 5 connected to the retaining bar 11 is not able to tilt under load.

At least one end face 14 of each of the threaded spindles 10 has a tool recess 18 that is accessible through an opening 17 in the housing side wall 31 for the positive-fit engagement by a rotary tool, for instance a hex socket for use with an Allen wrench. The hinge tab 12 may be displaced within the housing 8 longitudinally of the spindles 10 and perpendicular to the side-wall faces 15 by rotation the threaded spindles 10. This allows a lateral adjustment of the door 2 relative to the door jamb 1.

Figure 3:
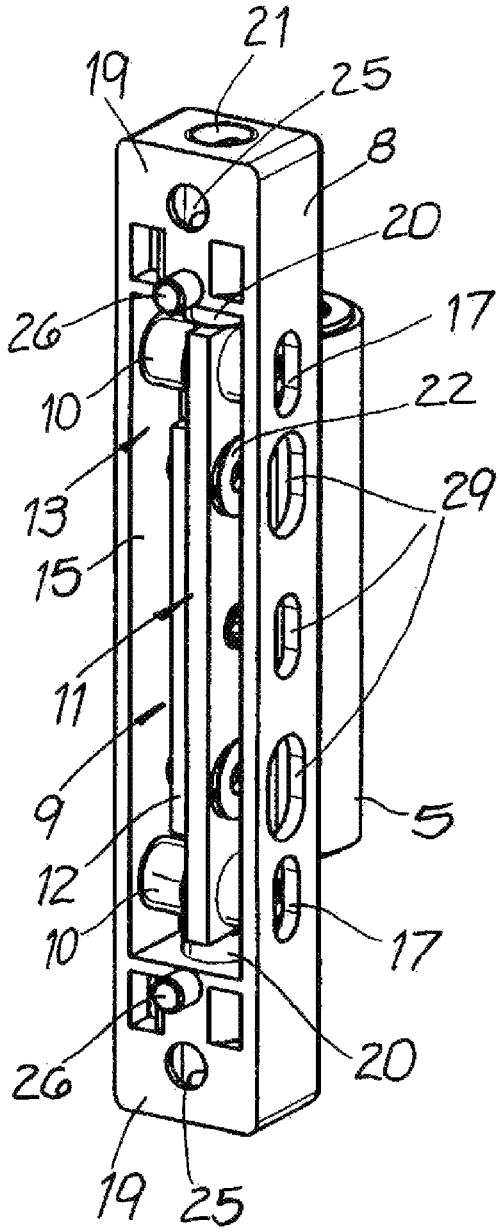
FIG. 3 shows the jamb-side parts of the hinge of the door hinge shown in FIG. 2, in assembled condition.

According to FIGS. 2 and 3, at its upper and lower ends the housing 8 has end pieces 19 in which vertically displaceable bearing elements 20 for supporting the retaining bar 11 are situated. The bearing elements 20 are screws, and are screwed into unillustrated vertical threaded holes in the end pieces. These bearing elements 20 are accessible through openings 21 at in the upper and lower end walls of the housing 8. The holder 9 may thus be vertically displaced within the housing 8 and the floor clearance of the door 2 may be adjusted by vertically displacing the bearing elements 20.

FIG. 3 shows that the retaining bar 11 and the hinge tab 12 are detachably connected to one another by screw fasteners 22 forming part of the holder 9. The screws 22 engage in threaded holes in the hinge tab 12 and pass through horizontally elongated openings or slots 32 in the retaining bar 11. The slots allow relative movement of the retaining bar 11 and the hinge tab 12 in the horizontal insertion direction of the hinge tab before the screws 22 are tightened. The illustration also shows that the screws 22 have flat countersunk heads and are in approximately flush with the retaining bar 11.

An adjusting eccentric 23 that is seated in the bar 11 and engages into a vertical slot 24 in the hinge tab 12 cooperates with the this hole so that, when it is rotated with the screws 22 loosened, the tab 12 moves horizontally relative to the bar 11. This allows one to adjust the front-to back fit of the door against the jamb 1, something that is critical in a plastic door or window assembly with a seal as shown.

The housing 8 of the mount 7 is designed as a one-piece cast metal part, and has two openings 25 for fastening screws as well as centering lugs 26 that project at the back from the housing.

The hinge leaves 5 and 6 are pivoted together at a standard knuckle having the axis-defining pintle 27. The hinge leaf 6 on the door panel has an angle bracket 28 that is screwed to the narrow edge of the door 2. In the closed state of the door, the angle bracket 28 conceals access holes 29 in the housing side wall 31 of the mount 7. When the door is opened, the installation openings 29 are accessible and allow actuation of the threaded spindles 10, the screws 22 that fix the hinge tab 12 to the retaining bar 11, and the adjusting eccentric 23.

I claim:

1. A hinge for mounting a door-panel or window sash forming a first element to a fixed jamb forming a second element, the hinge comprising:

two leaves pivoted together about an axis, one of the leaves being adapted for attachment directly to an edge of one of the elements;

a housing adapted for recessing in the other of the elements and having a pair of generally parallel and vertical side walls with inner faces defining a horizontally open cavity;

a bar shiftable in the cavity horizontally perpendicular to the side walls and vertically;

at least one fastener releasably securing the other of the leaves to the bar; and a pair of spindles extending perpendicular to the side walls in the cavity, threaded into the bar, and having opposite ends bearing on the inner faces of the side walls, whereby rotation of the spindles shifts the bar perpendicular to the side walls.

2. The hinge defined in claim 1 wherein each of the spindles has one end bearing on one of the side walls and formed with a tool recess, one side wall being formed in line with each of the tool recesses with a throughgoing hole for access by a tool through the holes with the recess and rotation of the spindles from outside the housing by the tool.

3. The hinge defined in claim 1 wherein the housing has a front wall bridging the side walls and forming therewith the cavity, the bar extending along and bearing horizontally on the front wall.

4. The hinge defined in claim 3 wherein the housing has a pair of vertically spaced end walls extending between the side walls and vertically flanking the bar, the bar bearing vertically on the end walls.

5. The hinge defined in claim 4, further comprising respective adjustment elements supported on the end walls and bearing vertically on the bar, whereby movement of the adjustment elements vertically shifts the bar.

6. The hinge defined in claim 5 wherein the end walls have threaded holes in which the adjustment elements are threadedly engaged.

7. The hinge defined in claim 3 wherein the cavity has a depth substantially equal to a horizontal width of the bar.

8. The hinge defined in claim 4 wherein the side walls, front wall, and end walls are unitarily formed of cast metal.

9. The hinge defined in claim 1 wherein the fastener is at least one screw.

10. The hinge defined in claim 9 wherein the bar is formed with a horizontally elongated slot through which the screw engages.

11. The hinge defined in claim 10, further comprising an eccentric cam carried on the bar, engaging the other leaf, and rotatable to shift the other leaf horizontally on the bar.

12. The hinge defined in claim 9 wherein the screw has a flat head with a tool recess.

* * * * *